United States Patent [19]

Frantsenjuk et al.

[11] 4,093,023

[45] June 6, 1978

[54] SHEET MILL TABLE ROLL

[76] Inventors: Ivan Vasilievich Frantsenjuk, ulitsa Parkovaya, 3, kv. 15; Andrei Dmitrievich Belyansky, ulitsa Parkovaya, 3, kv. 16; Leonid Semenovich Bobylev, prospekt Mira, 11, kv. 22; Zinovy Petrovich Karetny, prospekt Mira, 27, kv. 7, all of Lipetsk; Nikolai Nikitievich Alexandrov, Sharikopodshipnikovskaya ulitsa, 2, kv. 147, Moscow; Vasily Ivanovich Kulikov, Krasnodarskaya ulitsa, 12, kv. 113, Moscow; Evgeny Vladimirovich Kovalevich, Frunzenskaya naberezhnaya, 24, kv. 38, Moscow; Viktor Gurievich Tinyakov, Juzhno-Portovaya ulitsa, 16, kv. 23, Moscow; Alexandr Vladimirovich Bolotnov, Kavkazsky bulvar, 47, kv. 37, Moscow; Jury Alexandrovich Chernov, prospekt Lenina, 30, kv. 50, Alma-Ata; Vladimir Mikhailovich Kolesov, ulitsa Kirova, 89, kv. 10, Alma-Ata; Nikolai Matveevich Svetlakov, 6 Mikroraion, 10a, kv. 50, Alma-Ata; Gennady Nikolaevich Burmistrov, mikroraion "Orbita-I", 25, kv. 74, Alma-Ata; Jury Grigorievich Kuxenko, ulitsa 12 Linia, 67, Alma-Ata, all of U.S.S.R.

[21] Appl. No.: 699,438

[22] Filed: Jun. 24, 1976

[51] Int. Cl.[2] ..... F28D 11/02

[52] U.S. Cl. ..... 165/89; 29/110; 29/129.5

[58] Field of Search ..... 165/89, 90; 29/110, 29/113 AD, 116 AD, 121.2, 121.4, 114, 123, 129.5; 69/30

[56] References Cited

U.S. PATENT DOCUMENTS

| | | | |
|---|---|---|---|
| 693,233 | 2/1902 | Chadwick | 29/114 X |
| 2,259,024 | 10/1941 | Cleveland | 165/89 |
| 2,687,699 | 8/1954 | Oakes | 165/89 X |
| 2,958,742 | 11/1960 | Palmer | 165/89 X |
| 3,000,149 | 9/1961 | Johnson | 29/121.2 X |
| 3,242,583 | 3/1966 | Calkins | 165/89 X |
| 3,466,904 | 9/1969 | Huni | 69/30 |
| 3,885,283 | 5/1975 | Biondetti | 29/116 AD |

*Primary Examiner*—Alfred R. Guest

*Attorney, Agent, or Firm*—Lackenbach, Lilling & Siegel

[57] ABSTRACT

A sheet mill table roll in the form of a cylindrical hollow body having hubs therewith fixed therewith on half-axles mounted in table bearing supports. Each end face of the cylindrical hollow body has a coaxially mounted cover with a central port. The diameter of the central port is essentially smaller than the outside diameter of the hub which is fitted with through channels running at its periphery. The covers form with said half-axles annular slots for the passage of cooling fluid through the interior of the roll body.

4 Claims, 6 Drawing Figures

SHEET MILL TABLE ROLL

The present invention relates to sheet mill practice and more particularly to sheet mill table rolls.

The invention may prove to be most advantageous in runout tables of hot wide-strip mills.

Known in the art is a mill table roll which is a cylindrical hollow body with half-axles which are press-fitted therein through roll hubs and on which said roll is rotating in bearings. As a hot strip is moving over said rolls, the latter are cooled by spraying cooling fluid (e.g. water) onto their external surface, said fluid being fed from perforated pipes, of which each is arranged intermediate of the two adjacent rolls.

In order to enhance the strength, wear and scale resistance of the roll body it is manufactured in heat-resistant cast iron with spheroidal (compact) graphite. As the hot strip is moving on the roll table, its rolls are heated to a temperature of about 400°-500° C which exceeds considerably the water boiling temperature. As a result, when water is brought into contact with the roll exterior, a steam interlayer is formed which in turn adversely affects heat exchange between the roll and the cooling fluid.

As the roll rotates with a high speed, the cooling water is centrifugally diverted from the external surface of said roll, minimizing thereby the roll-to-coolant contact time and thus causing the ensuing overheating of the roll.

Such overheating deteriorates mechanical properties, scale and wear resistance of the roll body material and further leads to rapid wearing down of the roll.

Moreover, pipe openings are clogged with scale and other solids which causes nonuniform cooling of the roll body, its distortion and failure.

The main object of the present invention is the provision of a sheet mill table roll having such a cooling system which would allow enhancing functional reliability and longevity of the roll, as compared with similar type prior-art rolls.

Another no less important object of the invention is to provide a sheet mill table roll with such a cooling system which would enable a reduction in the consumption of cooling fluid for its cooling, as compared with similar type prior-art rolls.

Still another object of the present invention is the provision of a sheet mill table roll with such a cooling system which would reduce roll warpage and thermal stresses arising due to one-side heating of the surface layers of the roll body at the point of its contact with the moving strip, as compared with similar type prior-art rolls.

These and other objects of the invention are achieved by providing a sheet mill table roll which is a cylindrical hollow body having hubs fixed on half-axles mounted in table bearing supports each end face of the cylindrical hollow body is provided with a cover mounted coaxially therewith and having a central port whose diameter is essentially smaller than the outside diameter of the hub which is fitted with through channels running at its periphery, and each said cover forming with said half-axle an annular slot for the passage of cooling fluid through the interior of the roll body.

The presence on the roll body of the cozxially mounted covers, with their central ports, as well as the through channels running at the hub peripheries enables the cooling fluid to be fed in the roll body interior, and to be uniformly distributed over the interior of the roll body during its rotation under the effect of centrifugal forces.

The allows enhancing functional reliability and longevity of the roll due to more efficient cooling thereof. Moreover, the consumption of the cooling fluid diminishes because it is possible to decrease the rate of cooling of the roll exterior and, finally, a uniform distribution of the cooling fluid over the roll body interior decreases thermal stresses brought about by oneside heating of the surface layers of the roll body at the point of its contact with the moving strip.

It is expedient that the cylindrical hollow roll body have a helical groove on its external surface.

This will compensate for thermal expansion of the surface layers of the roll body brought about when the roll comes in contact with a hot strip and when it is being cooled with the cooling fluid.

It is advisable that the roll body interior communicate through the annular slots formed by the covers and half-axles and through pipes, running accordingly on the side of one of its end faces with a cooling fluid supply source, and on the side of its other end face with a fluid discharge means.

This will ensure more uniform distribution of the cooling fluid over the interior of the roll body.

It is also advantageous if the pipe through which the body interior communicates with the cooling fluid supply source is mounted so that its end would be arranged in the direction of rotation of the roll, while the other end of the pipe through which the roll body interior communicates with the fluid discharge means has a tapered edge and is arranged opposite to the direction of rotation of the roll in the section defined by the external surface of the hub and central cover port.

This would reduce the spattering of the cooling fluid fed in the roll body interior.

The nature of the invention will be clear from the following detailed description of a particular embodiment to be had in conjunction with the accompanying drawings, in which.

Figure 1:
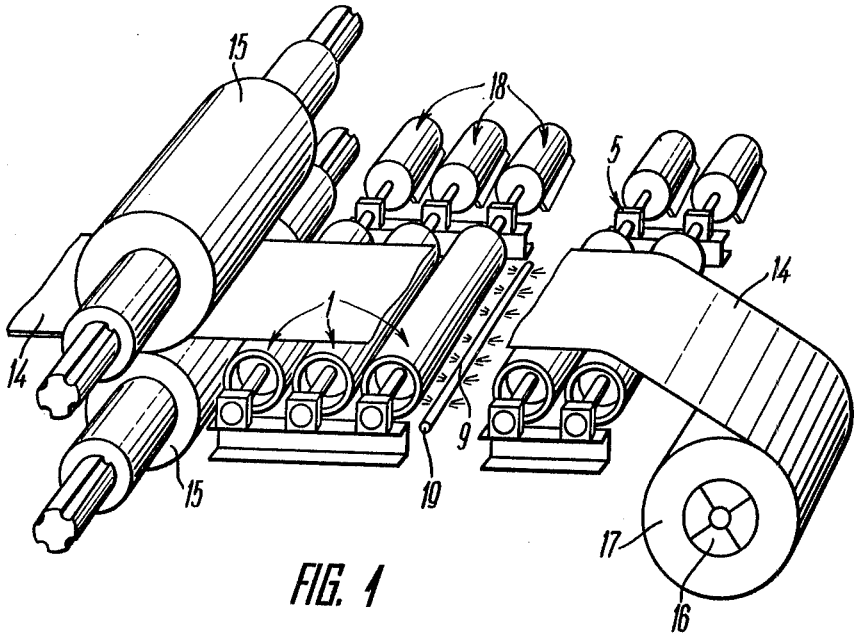
FIG. 1 is a general view of a mill table with a broken-out section.
Figure 2:
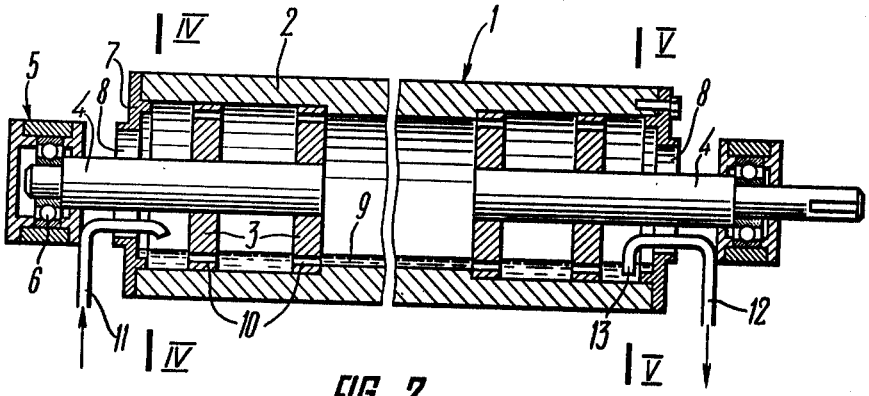
FIG. 2 shows a table roll in cross-section and with a broken-out section.

A roll 1 (FIG. 1) of a sheet mill table is a cylindrical hollow body 2 (FIG. 2) having hubs 3 and fixed therewith on half-axles 4. The half-axles 4 are mounted on table bearing supports 5 and rotate in antifriction bearings 6. Each end face of the cylindrical hollow body 2 of the roll 1 is provided with a cover 7 mounted coaxially therewith and having a central port 8. The diameter of said port 8 is essentially smaller than the outside diameter of the hub 3, thus resulting in the cooling fluid 9 being retained in the interior of the body 2 of the roll 1. To enable a uniform distribution of the cooling fluid 9 in the interior of the body 2 of the roll 1 and the hub 3 has through channels 10 running along its periphery.

From the end faces of the body 2 of the roll 1, the cover 7 and the half-axle 4 form annular slots for the passage of the cooling fluid 9 through the interior of the body 2 of the roll 1. One such slot accommodates a pipe 11 supplying the cooling fluid 9, whereas the other one is adapted to receive a pipe 12 discharging the cooling fluid 9.

Figure 4:
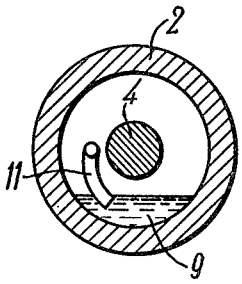
FIG. 4 is a sectional view, taken along the line IV—IV of FIG. 2.
Figure 5:
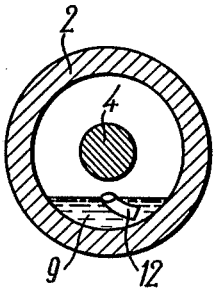
FIG. 5 is a sectional view taken along the line V—V of FIG. 2.
Figure 6:
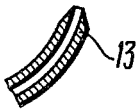
FIG. 6 represents the end of a pipe for discharging cooling fluid.

The pipe 11 (FIGS. 4, 5 and 6) adapted for supplying the cooling fluid 9 is mounted so that its end is arranged in the direction of rotation of the roll 1. The pipe 12 adapted to discharge the cooling fluid 9 from the interior of the body 2 of the roll 1 is arranged so that its end 13 having a tapered edge is disposed opposite to the direction of rotation of the roll 1 in the section defined by the external surface of the hub 3 (FIG. 2) and the central port 8 of the cover 7. Such pipe layout reduces the spattering of the cooling fluid 9 which is fed in the interior of the body 2 of the roll 1 and of the fluid flowing thereout out of the same.

Figure 3:
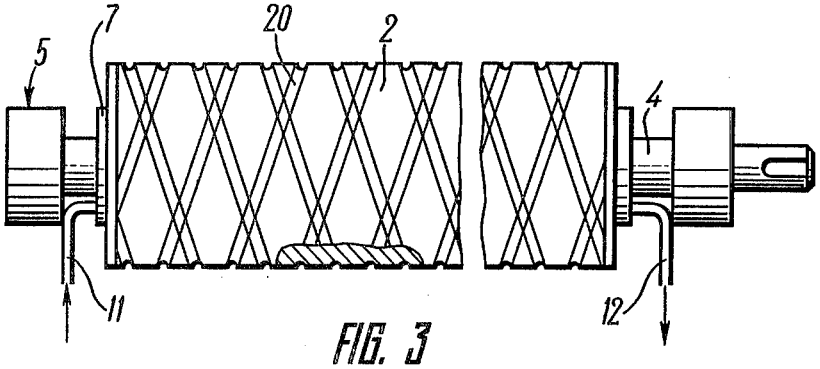
FIG. 3 is a side view of a table roll with a broken-out section.

To compensate for thermal expansion of the surface layers of the body 2 of the roll 1 one or several helical grooves 20 are cut on the external surface of the roll body, and said grooves 20 are running in different directions (FIG. 3).

The sheet mill table roll operates in the following manner.

Hot strip 14 emerging from under the mill rolls 15 of a finishing stand (not shown in the drawing) passes onto the runout table rolls 1 which convey it to a strip reel 16 where said strip 14 is reeled into a coil 17. Each roll 1 rotates in the antifriction bearings 6 being driven by an electric motor 18. The rolls 1 are cooled by spraying their exterior with cooling fluid. To accomplish this perforated pipes 19 run along each roll 1, and the cooling fluid 9 is fed through said perforations.

As the roll 1 is rotating in the bearings 6, the cooling fluid 9 is supplied from the source of said cooling fluid along the pipe 11 through the slots into the interior of the body 2 of the roll 1 and under the effect of centrifugal forces it is uniformly distributed over the internal surface of the cylindrical hollow body 2 of the roll 1. Due to positive discharge of the cooling fluid 9 with the help of the pipe 12, having the tapered edge 13, the cooling fluid passes along the hollow body 2 from the supply pipe 11 to the discharge pipe 12. To enable the passage of the cooling fluid through the hubs 3, the latter are provided with the through channels 10.

The thickness of a cooling fluid layer varying from 10 to 20 mm is determined by the distance between the end of the discharge pipe 12 and the outside diameter of the hub 3. The larger said distance, the greater is the thickness of the layer of the cooling fluid.

When the roll stops, excess cooling fluid is discharged through the annular slots. Some fluid remains in the bottom part of the body 2 of the roll 1.

What we claim is:

1. A sheet mill table roll, comprising: a cylindrical hollow body; half-axles accommodated within said cylindrical hollow body and mounted on table bearing supports; said cylindrical hollow body having hubs fixed on said half-axles; through channels provided at the periphery of said hubs; covers mounted on each end face of said hollow body; a central port provided in each said cover and having a diameter essentially smaller than the outside diameter of said hub and; annular slots formed by said covers and said half-axles.

2. A roll of claim 1, wherein said cylindrical hollow body has a helical groove running on its external surface.

3. A roll of claim 1, in which the interior of its body communicates through said annular slots formed by said covers and said half-axles and through pipes, accordingly, on one of its end faces with a cooling fluid supply source and on its other end face with a means adapted for discharging said cooling fluid.

4. A roll of claim 3, in which the pipe through which the interior of said roll body communicates with the source of the cooling fluid is mounted so that its end is arranged in the direction of rotation of said roll, while the end of the pipe through which the interior of said body communicates with the means for discharging the cooling fluid has a tapered edge and is arranged opposite to the direction of rotation of the roll in the section defined by the external surface of said hub and said central port of said cover.

* * * * *